United States Patent [19]

Vanderheijden

[11] 4,426,794

[45] Jan. 24, 1984

[54] APPARATUS FOR HANDLING LAUNDRY

[75] Inventor: Herman E. C. Vanderheijden, Aalter, Belgium

[73] Assignee: E. M. D'Hooge N.V., Ledeberg, Belgium

[21] Appl. No.: 317,556

[22] Filed: Nov. 2, 1981

[51] Int. Cl.³ ..... F26B 11/04

[52] U.S. Cl. ..... 34/109; 34/56; 34/133; 34/126; 414/160; 366/88; 366/150

[58] Field of Search ..... 414/160, 287; 366/87, 366/88, 150; 34/133, 56, 126, 202, 109

[56] References Cited

U.S. PATENT DOCUMENTS 2,817,501 12/1957 Schubert .

FOREIGN PATENT DOCUMENTS 209300 5/1960 Austria ..... 34/109

*Primary Examiner*—Larry I. Schwartz

*Attorney, Agent, or Firm*—Diller, Ramik & Wight

[57] ABSTRACT

A device for treating textiles, such as laundry, for example cleaning and drying, mainly comprising a closed housing 1 having openings 5, 6 being pneumatically closable for inserting and taking out respectively the laundry, a shaft 2 driven by 4 and rotatably journalled in said housing 1 and a drum supported by the shaft 2 and to be rotated for receiving the laundry, said drum consisting of at least two sections 7 axially displaceable through a roller or slide element 11 along a wing-like carrier 10 fastened to said shaft 2. In the carrier 10 tensioning means are provided for in order to tension said sections 7 during washing and centrifuging.

19 Claims, 8 Drawing Figures

Figure 2:
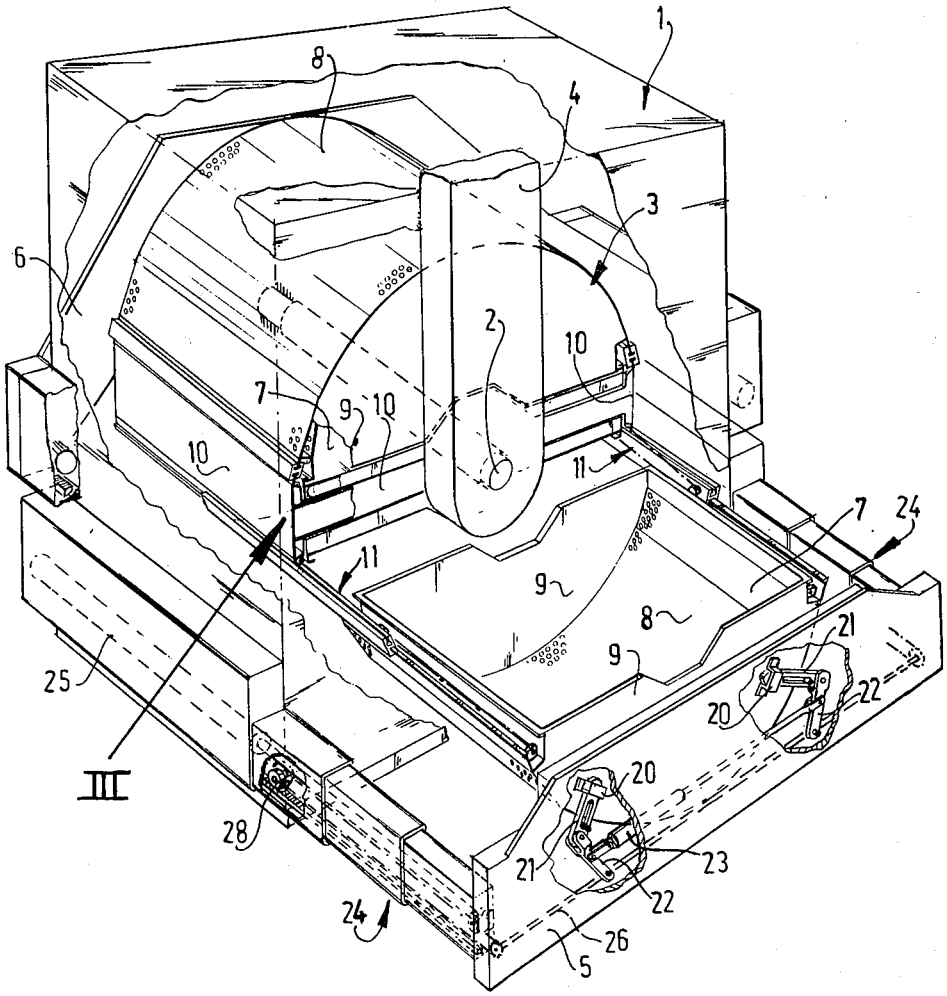

FIG.1
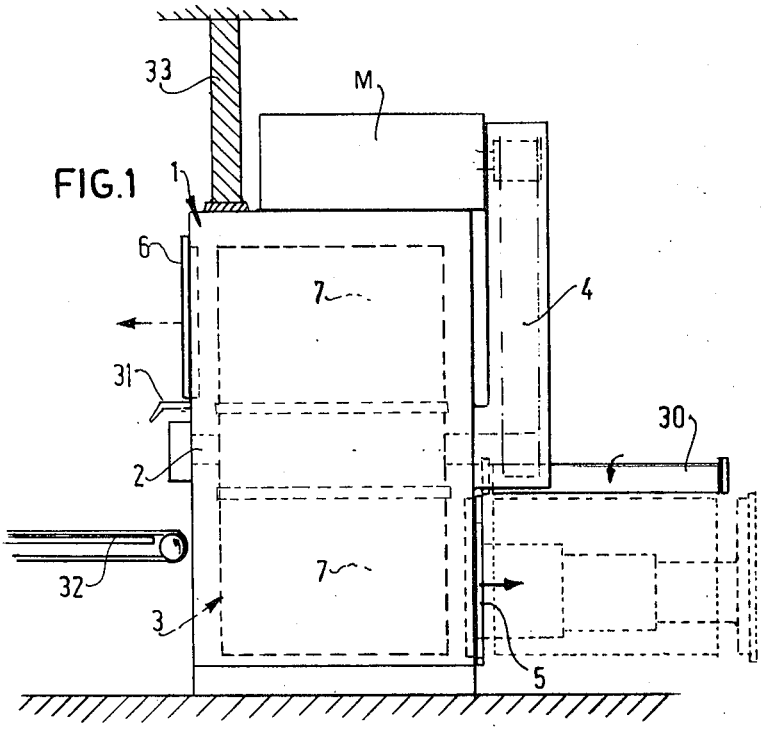
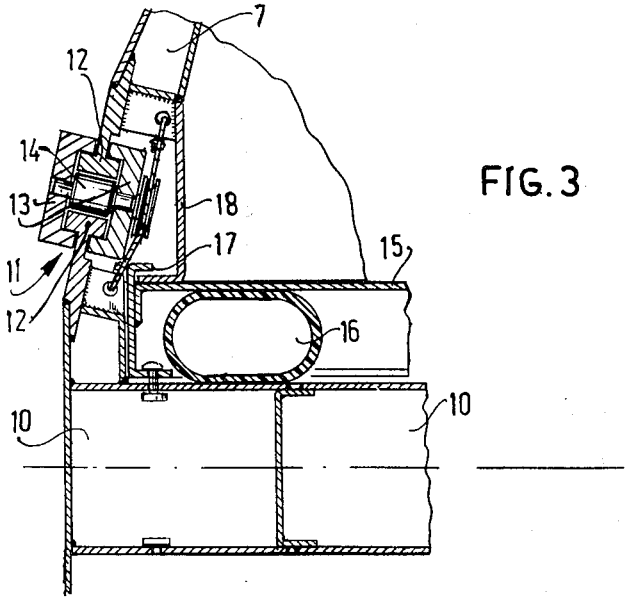
FIG. 3

APPARATUS FOR HANDLING LAUNDRY

The invention relates to a device for treating textiles, for example, cleaning and drying, mainly comprising a closed housing having at least one opening that can be closed for inserting and taking out respectively the textile ware, a driven shaft rotatably journalled in said housing and a drum supported by the shaft and to be rotated for receiving the textile, said drum consisting of at least two relatively axially displaceable sections.

Such drum machines of the kind set forth are known in many embodiments for domestic and industrial use. The invention, however, relates in particular to machines of the industrial type, which can deal with comparatively large quantities of textile ware.

The industrial machines constitute part of a whole process for treating textiles and one of the problems involved is the supply and delivery of the quantity of textiles in the machine or the drum respectively. It is known, for example, in a domestic machine to slip out a section through an opening in the housing for introducing or removing the textiles. In this machine the drum is not divided into compartments so that the delivery of washings cannot be automated. Moreover, high speeds for centrifuging cannot be obtained.

The invention has for its object to improve a device of the kind set forth to an extent such that the above-mentioned drawbacks are obviated.

The device according to the invention is distinguished in that the shaft is provided with a carrier fastened thereto, along which each drum section is slidably fastened.

The use of a carrier fastened to the shaft has the advantage that a very robust construction is obtained, which can resist very high rotary speeds as occur in centrifuging. The carrier provides furthermore the advantage that the drum can be easily divided into two or more compartments so that washings of different kinds can be simultaneously washed. Moreover, one of the compartments can now be disposed so that, when it is slid out, the washings automatically drop out of the compartment.

A stable slide guide is ensured by arranging the guide for each drum section along the end rims of the drum jacket.

In order to enlighten the actuation the guide is preferably provided with a roller element for reducing frictional resistance. Instead a synthetic resin lining may be provided as an alternative. This lining provides, in addition, an improved distribution of forces.

In order to ensure a firm connection between the drum sections and the shaft during the treatment of the textiles tensioning means are provided to clamp each drum section. These tensioning means are preferably formed by an inflatable body by which each drum section is moved away from the carrier.

In one embodiment the or each door for closing the inlet or outlet opening respectively of the housing is slidably guided parallel to the rotary shaft of the drum, the door being provided with means for coupling with a drum section. In this way the weight of the drum and the textiles contained therein is partly absorbed by the guide of the drum itself and partly by the guide of the door.

In a further embodiment each door is constructed in the form of a swing door, whilst the drive for sliding the drum forward is formed by a cylinder engaging the roller or sliding element between the drum sections.

The above-mentioned and further features of the invention will be explained more fully in the following description of the Figures of two embodiments.

Figure 4:
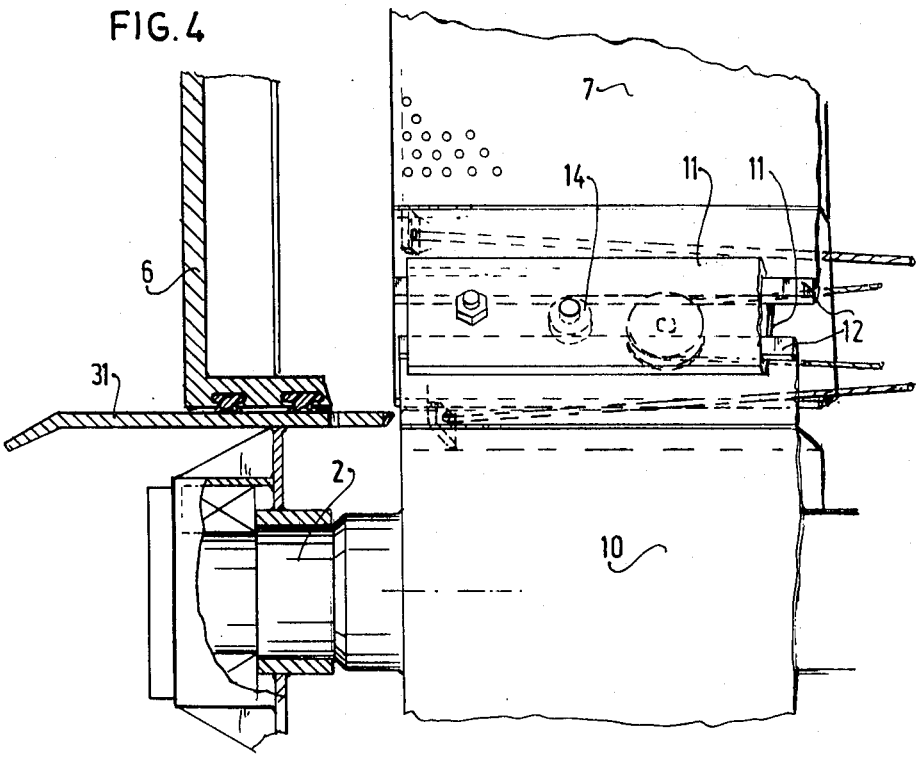
Figure 8:
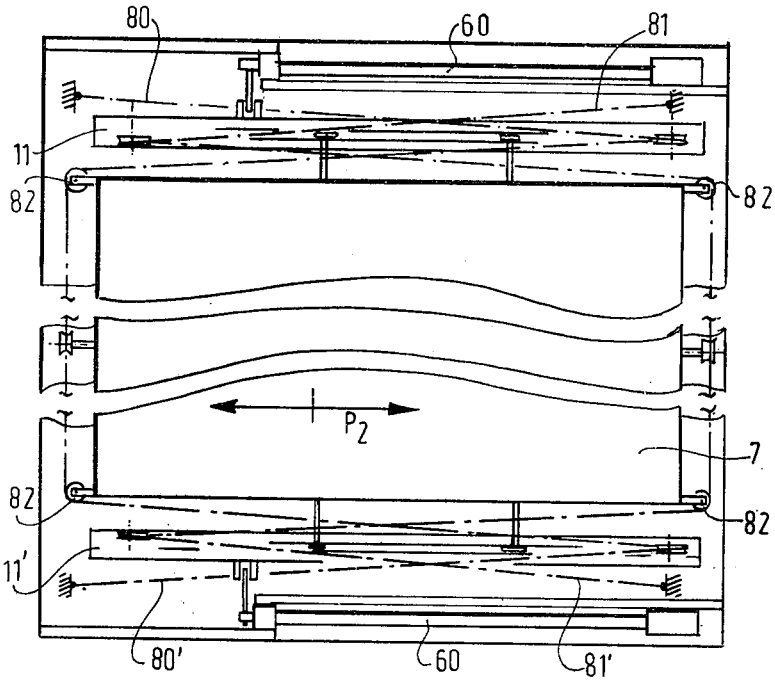
Figure 5:
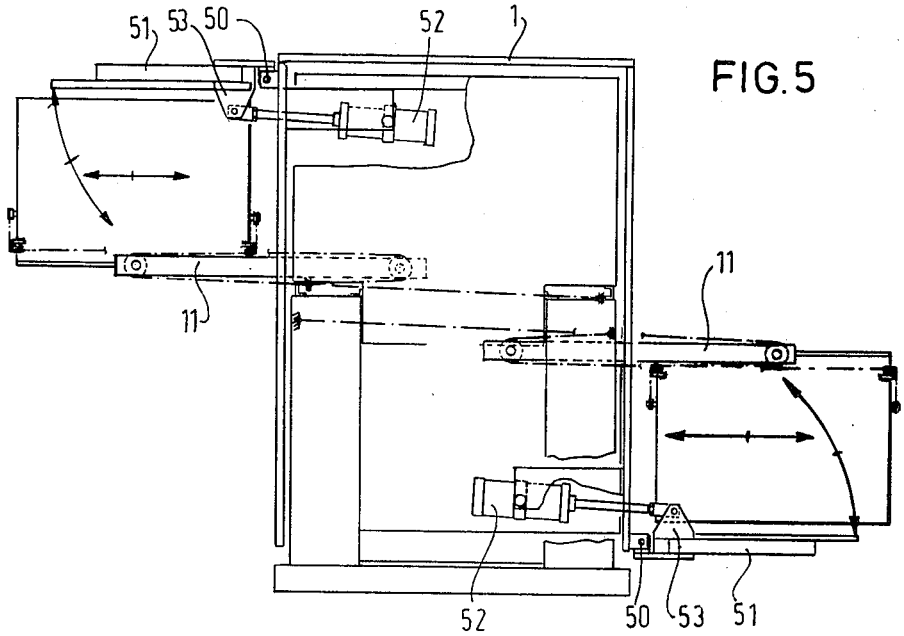
Figure 6:
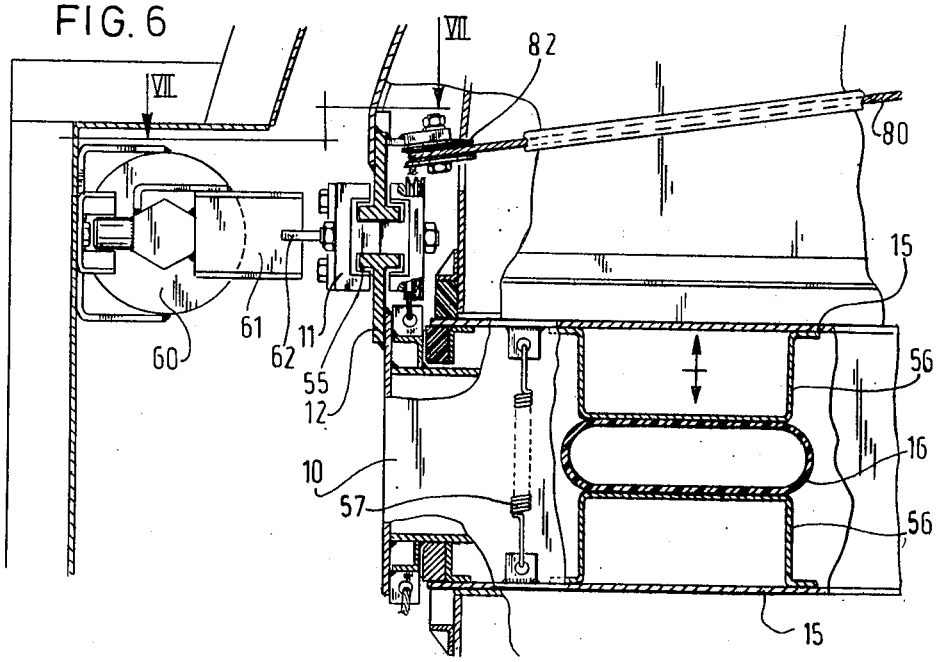
Figure 7:
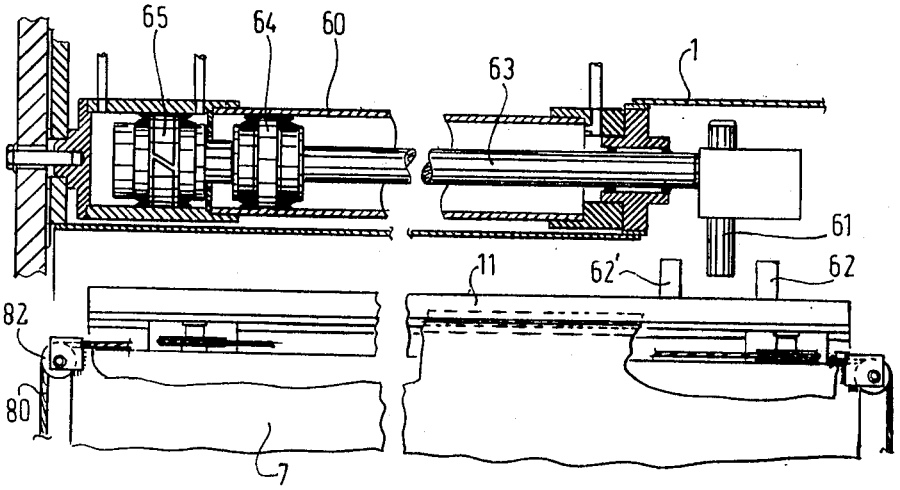

The drawing shows in:

FIG. 1 a schematic side elevation of a first embodiment of the device in accordance with the invention, FIG. 2 a perspective view of the device of FIG. 1, FIG. 3 a front view of a detail of the sliding guide indicated by the arrow III in FIG. 2, FIG. 4 an elevational view like FIG. 1 of a detail of the device, FIG. 5 a side elevation of a second embodiment of the invention, FIG. 6 a sectional view of a detail of the guide of the drum section with respect to the impeller carrier used in the embodiment of FIG. 5, FIG. 7 a plan view taken on the line VII—VII in FIG. 6, FIG. 8 a schematic plan view of the drive and the guide respectively of a drum section with respect to the carrier.

The device shown in FIGS. 1 to 4 mainly comprises a closed housing 1, in which a drum 3 is rotatably driven around a horizontal shaft 2. To this end the shaft 2 is prolonged on the right-hand side in FIG. 1 to beyond the housing 1, on which prolongation a pulley of a rope transmission 4 is fastened. The rope transmission 4 is driven by a motor M (not further described) which is disposed on top of the housing 1.

The housing 1 is provided on one side with a door 5 for introducing the textiles and on the other side with a door 6 located at a higher level for delivering the textiles. The operation of the doors will be described more fully hereinafter.

The two doors 5 and 6 are provided with sealing means such that in the closed state the housing 1 may contain a detergent across which the drum 3 is rotated.

According to a main aspect of the invention the drum is divided into sections and in the embodiment shown every two diametrically opposite, identical sections 7 (see FIG. 2) can be slid out of the openings 5 and 6 respectively.

Each drum section comprises a circular jacket wall 8 connected on the head side with two end walls 9.

The shaft 2 is provided with two diametrically opposite wings 10 consisting of a hollow construction (see FIG. 3), the axial length of which corresponds with that of each drum section 7 and the radial length of which corresponds to the distance between the end rims of the jacket surface 8.

The drum sections 7 are slidably connected in an axial sense with the wings 10 by means of a sliding guide 11 shown in detail in the sectional view of FIG. 3.

The sliding guide comprises two T-shaped, thickened longitudinal strips 12 connected with the wing 10 and the drum section 7 respectively, about which grips a U-shaped intermediate piece 13 on the outer and inner sides of the drum. Between the U-shaped parts rollers 14 are arranged to roll along the head side of the T-shaped strip part 12. Such a roller guide reduces considerably the frictional resistance. During the axial displacement of each drum section 7 the intermediate piece 11 will each time slide along over half the distance (see FIGS. 2 and 4). To this end the intermediate piece 11 is provided on both sides with a freely rotatable roller along which a cable is passed. Each cable is fastened at one end to the displaceable drum section 7 and at the other end to the wing 10.

Parallel to the hollow wing 10 is arranged a loose wall 15, below which a blowing body 16 is arranged. The wall 15 is guided in a U-shaped guide 17 secured to the wing 10. Between the upper flange of the guide 17 and the wall 15, which can move up and down, extends the flange of a protective wall 18 of the drum section 7. The arrangement is such that an axial displacement of the drum section 7 is ensured whilst nevertheless adequate protection of the sliding guide 11 with respect to the textiles contained in the drum section is obtained.

In the industrial treating device of high capacity shown in the Figures the sliding guide 11 does not suffise to absorb the weight of the drum section 7 with the textiles contained therein, as is shown in the position of FIG. 2. Therefore, a head wall 9 of each drum section is provided with coupling means for connecting the door 5 and 6 respectively with the head wall 9. The coupling means shown are formed by two brackets 20 into which can grip a latch 21. The latch is connected with a lever 22 pivotably connected with the inner side of the door, a pneumatic ram 23 being arranged between every two of them.

The door itself is supported by a telescopic sliding guide 24 of a size such that high bending stress in a vertical sense can be absorbed. The telescopic sliding guide 24 comprises a pneumatic ram 25, by which the door can be moved into the open and closed positions. Moreover a synchronous mechanism ensures a smooth opening and closing of the telescopic guide 24 on both sides of the door. A pinion 28 journalled in a telescopic part rolls along a toothed rack connected with the door. A torsional rod 26 rotatably journalled in the door is provided on both sides with a pinion rigidly secured thereto, along which is passed a chain which drives the pinion 28.

Although this is not shown in detail, the construction for the upper door 6 is the same as for the door 5 on the rear side of the device in FIG. 2. This door is also connected by corresponding coupling means with the head wall 9 of each drum section 7.

The device described above operates as follows.

In order to fill the drum 3 it has to be turned so that the hollow wings 10 are in a substantially horizontal position so that a head wall 9 of a drum section 7 can be clamped by means of the latches 21, which drop in the backets 20 after the ram 23 is energized. Subsequently the ram 25 can be energized so that the door 5 is slid out, carrying along the drum section 7, which slides outwards by means of the sliding guide 11 in an axial sense with respect to the wing-shaped carrier 10. Owing to this construction a large space is formed for filling the lower section of the drum (see FIGS. 1 and 2). Filling can be performed by means of a feeding conveyor 30, but as an alternative, as well by means of gutters or even by hand. After a sufficient quantity of textiles is deposited in the drum section 7, the ram 25 is energized in the reverse sense so that the door slides inwards, carrying along the drum section 7. Subsequently, the inflatable body 16 can be charged with a pressure medium so that the wall 15 is urged downwards until the T-shaped ends of the end strips 12 are firmly clamped in the U-shaped elements 13 of the intermediate element. Thus a firm connection is established between the drum section 7 and the hollow wing 10.

After disengagement of the latches 21 from the brackets 20 the drum can be turned through 180°, as a result of which the upper, empty drum section turns into the lowermost position, after which the cycle described above can be repeated.

For completely filling the drum the normal process of treatment can be carried out, for which purpose the detergent or cleaning fluid can be introduced through orifices (not shown) and dosing members falling beyond the scope of this invention. The motor M rotates in a conventional manner via the rope transmission 4 the drum with the desired speed.

After the treating cycle is accomplished, the drum can be emptied, for which purpose first the hollow wing 10 is turned into a horizontal position so that the upper drum section with the brackets 20 fastened thereto and the other head wall are located at the latches 21 of the coupling means in the door 6. When the inflatable body 16 is discharged, sufficient play is formed in the sliding guide 11. After this ram 25 associated with the door 6 is energized, this door is pushed outwards, carrying along the upper drum section. The textiles of this section are urged over and across the wall 15 by the rear head wall 9 and along the horizontal guide plate 31 the goods arrive at the delivery conveyor 32 (see FIG. 1).

The second drum section can be emptied in a similar manner after the drum is turned through 180°.

From the foregoing it will be obvious that the drum sections can be very readily filled and emptied, whilst large amounts of textiles can be simultaneously treated. Owing to the doors arranged on both sides the device may, in addition, be used as a "hygienic" treating device by disposing it at the height of a wall 33 (see FIG. 1) so that the supply is separated from the delivery. Such a disposition is, for example, suitable for use in hospitals.

FIGS. 5 to 8 show an alternative embodiment of the washing device in accordance with the invention.

The same parts are designated by the same reference numerals. The difference from the preceding embodiment resides in that the doors closing the openings of the housing 1 are constructed herein as swing doors 51 adapted to turn outwardly around the hinge 50. The outward swing of each door is performed by means of pneumatic rams 52, which are arranged in the housing 1 and the connecting rods of which engage a bracket 53 fastened to the door 51.

Each section is supported in the extreme position fully by an intermediate element in the form of the sliding guide 11, which is shown in detail in the cross-sectional view of FIG. 6. The sliding guide comprises a H-shaped piece provided on the inner side with nylon lining 55, which accommodate the T-shaped ends 12 of the drum sections. In contrast to the preceding embodiment the intermediate rollers are failing here and guiding is fully performed by the synthetic resin lining 55. This lining has the advantage that the load is evenly distributed along the full length of the T-shaped end parts 12 and respectively the flanges of the H-shaped intermediate piece so that this construction can hold very heavy loads as occurring, for example, in the centrifuging phase of the machine, in which accelerations of 10 gs (gravity) have to be taken into account. It should furthermore be noted that the T-shaped elements 12 are at right angles to the top wall of the carrier 10, in contrast to the inclined position of the wall in FIG. 3.

From FIG. 6 it is furthermore apparent that the inflatable body 16 is arranged here between two salient parts 56 of the closing plates 15 of the drum section. The closing plates 15 are drawn to one another in the rest position by springs 57 so that, when the drum section is slideout, they are released from the rim of the section and do not produce frictional resistance. The inflatable body 16 has the same function as in the preceding embodiment and via the plates 15 it will urge the whole drum section upwards so that the T-shaped end pieces 12 are firmly pressed against the flanges of the intermediate piece 11. Therefore, during the washing run the whole drum remains a rigid unit. It will be obvious that this construction guarantees a uniform load of the drum sections so that the inflatable body 16 can be replaced in a simple manner.

In the embodiment shown in FIGS. 5 to 8, in contrast to the preceding embodiment, each section can be slid outwards by means of a pneumatic ram 60 located on the outer side of the housing 1 (see FIGS. 6 and 7). For each section such a pneumatic ram 60 is provided at both ends of the housing 1 and each of them engages an intermediate piece 11 by means of the cam 61 which falls in between two cams 62 of the intermediate piece 11. From FIG. 7 it will be apparent that when the piston rod 63 of the ram 60 is slid to the right the right-hand cam 62 engages the cam 61 of the piston rod so that the intermediate piece 11 is shifted to the right in FIG. 7. Upon withdrawal the left-hand cam 62 is engaged and the intermediate piece is returned to the initial position. The piston 64 or the piston rod 63 can thus occupy the extreme left-hand position in the ram 60, whilst the intermediate piece 11 gets into the correct position centrally between the drum sections. The auxiliary ram 65 which is arranged coaxially with the main ram 60 will urge, when charged, the piston 64 over a predetermined distance to the right into the zero position so that the cam 61 gets exactly in between the cams 62 and the cam 62' so that it remains free thereof. Thus the drum can be rotated without the cams 62 coming into contact with the cam 61.

In order to avoid untrue running of the drum sections with respect to the sliding guide 11 a cable system like that of the preceding embodiment is arranged for each intermediate piece 11 so that the systems on both sides of each drum section are interconnected (see (FIG. 8). One cable 80 is connected with the cable 80' on the other side of the drum section 7, whereas the cable 81 is connected with the cable 81'. This is obtained by means of a cable part which is freely displaceable via guide wheels 82 at the corners of the drum section along a head end of the drum section 7. This driving system has the advantage that the rams 60 on both sides of the drum section 7 can arbitrarily move relatively to one another. When one intermediate piece 11 is slid forwards the cable 80, 81 will be carried along so that the drum is displaced over a given distance. When subsequently the other intermediate piece 11' is displaced the drum is again displaced over a given distance so that finally the drum covers twice the distance of the intermediate pieces. The cables are free to move along the head ends of the drum and they will load it only in the direction indicated by the arrow P2 with the exception of slight frictional losses. Thus any form of an untrue run is avoided and by the cable evening system obtained the rams 60 can move forwards and backwards independently of one another.

As a matter of course the invention is not limited to the two embodiments described above.

I claim:

1. A laundry device comprising a housing having upper and lower door openings and upper and lower doors; a drum assembly disposed within said housing and comprising diametrically opposed perforate drum sections, a horizontal shaft extending axially of the drum assembly and means carried by said shaft for slidably supporting each drum section and for isolating said drum sections from each other whereby each drum section forms, with such means, a separate compartment for containing laundry material; said upper and lower door openings being respectively above and below the axis of the drum assembly so that any drum section may be emptied by gravity by rotating the drum assembly to a position in which a particular drum section is uppermost and then sliding such drum section outwardly through said upper door opening, whereafter the particular drum sectiion may be loaded by sliding such drum section back into place, rotating the drum assembly so that the particular drum section is lowermost and then sliding such drum section outwardly through said lower door opening.

2. A device as defined in claim 1 wherein said upper and lower doors are positioned adjacent opposite ends of the drum assembly whereby one drum section may be unloaded as another drum section is loaded.

3. A device as defined in claim 1 wherein said means comprises a carrier fixed to said shaft.

4. A device as defined in claim 3 including a movable plate associated with each drum section between it and said carrier, and pressure means for urging each plate radially outwardly against its associated drum whereby to rigidify said drum assembly.

5. A device as defined in claim 2 wherein said means comprises a carrier fixed to said shaft.

6. A device as defined in claim 5 including a movable plate associated with each drum section between it and said carrier, and pressure means for urging each plate radially outwardly against its associated drum whereby to rigidify said drum assembly.

7. A device as defined in claim 1 including a floating slide connecting each side edge of each drum section with said means, and motion-transmitting means for causing each slide to move half the distance of its associated drum section.

8. A device as defined in claim 7 including pressure means for urging each drum section radially outwardly to rigidify the drum assembly by taking up slack created by each floating slide.

9. A device as defined in claim 8 wherein said means comprises a carrier fixed to said shaft and includes rails engaging said slides.

10. A device as defined in claim 9 wherein said means also includes a movable plate disposed between each drum section and said carrier, said pressure means acting between each plate and the carrier to urge each plate radially outwardly against its associated drum section.

11. A device as defined in claim 1 including support means slidably cantilevered to said housing and associated with said lower door for releasably engaging the lowermost drum section and supporting it while and as withdrawn for loading.

12. A device as defined in claim 11 including ram means for moving said support means.

13. A device as defined in claim 12 including ram means for moving the uppermost drum section.

14. A device as defined in claim 13 wherein said upper and lower doors are positioned adjacent opposite ends of the drum assembly whereby one drum section may be unloaded as another drum sectiion is loaded.

15. A device as defined in claim 11 wherein said means comprises a carrier fixed to said shaft.

16. A device as defined in claim 15 including a movable plate associated with each drum section between it and said carrier, and pressure means for urging each plate radially outwardly against its associated drum whereby to rigidify said drum assembly.

17. A device as defined in claim 11 including a floating slide connecting each side edge of each drum section with said means, and motion-transmitting means for causing each slide to move half the distance of its associated drum section.

18. A device as defined in claim 17 including pressure means for urging each drum section radially outwardly to rigidify the drum assembly by taking up slack created by each floating slide.

19. A device as defined in claim 18 wherein said means comprises a carrier fixed to said shaft and includes rails engaging said slides.

* * * * *